US010357898B2

(12) United States Patent
Wung

(10) Patent No.: US 10,357,898 B2
(45) Date of Patent: Jul. 23, 2019

(54) PORTABLE TILE CUTTER

(71) Applicant: REXON INDUSTRIAL CORP., LTD., Taichung (TW)

(72) Inventor: Chun-Ti Wung, Taichung (TW)

(73) Assignee: REXON INDUSTRIAL CORP., LTD., Taichung (TW)

( * ) Notice: Subject to any disclaimer, the term of this patent is extended or adjusted under 35 U.S.C. 154(b) by 64 days.

(21) Appl. No.: 15/611,117

(22) Filed: Jun. 1, 2017

(65) Prior Publication Data

US 2017/0348873 A1 Dec. 7, 2017

(30) Foreign Application Priority Data

Jun. 2, 2016 (TW) ..... 105117364 A

(51) Int. Cl.

| | |
|---|---|
| ***B28D 3/02*** | (2006.01) |
| ***B28D 1/22*** | (2006.01) |
| ***B28D 1/24*** | (2006.01) |
| ***B25F 5/02*** | (2006.01) |
| ***B28D 1/04*** | (2006.01) |

(52) U.S. Cl.

CPC ..... *B28D 1/228* (2013.01); *B25F 5/026* (2013.01); *B28D 1/045* (2013.01); *B28D 1/24* (2013.01)

(58) Field of Classification Search

CPC ..... B24B 23/00; B24B 23/02
USPC ..... 451/359, 358; 125/13.01, 12
See application file for complete search history.

(56) References Cited

U.S. PATENT DOCUMENTS 1,830,579 A * 11/1931 Wappat ..... B23D 59/002 30/391
4,060,940 A * 12/1977 DeWitt ..... B24B 55/05 451/358
2009/0229436 A1* 9/2009 Crain ..... B27B 5/08 83/373
2009/0241350 A1* 10/2009 Lau ..... A01G 3/053 30/199

OTHER PUBLICATIONS

Hitachi Koki Co., Ltd. Power Tools CM12Y 305mm (12") Disc Cutter.
Lee Yeong Industrial Co., Ltd C14 & C16 Introduction & Operation Concrete Saw.

* cited by examiner

*Primary Examiner* — Robert A Rose
(74) *Attorney, Agent, or Firm* — Bacon & Thomas, PLLC

(57) ABSTRACT

A portable tile cutter includes a main unit having a base frame and a guard connected to the base frame, a cutter blade pivotally mounted at the guard, a driving unit connected to the guard and operable to rotate the cutter blade, a first handle connected to the driving unit, and a second handle connected to the guard and providing a grip. The component parts of the portable tile cutter are so arranged that moving one or both the driving unit and the second handle can achieve adjustment of the gap between the first handle and the grip of the second handle. Thus, the portable tile cutter can fit different users having different body sizes.

8 Claims, 7 Drawing Sheets

PORTABLE TILE CUTTER

BACKGROUND OF THE INVENTION

1. Field of the Invention

The present invention relates to tile cutter technology and more particularly, to a portable tile cutter.

2. Description of the Related Art

A known portable tile cutter (model "CM12Y" of Hitachi Koki Co., Ltd) comprises a guard, a cutter blade pivotally mounted in the guard, a driving unit connected to the guard and adapted for rotating the cutter blade, a first handle connected to the driving unit, and a second handle positionable relative to the guard. The first handle and the second handle are fixed to the guard, i.e., the isolation distance between the first handle and the second handle is fixed. However, because different users have different body sizes, a different user may be unable to hold the first handle and the second handle steadily during operation due to the nonadjustable isolation distance between the first handle and the second handle.

Further, Li-Fong-Da Industrial Company Taiwan discloses another design of tile cutter (model "LFD-AGP C14"). According to this design, the isolation gap between the first handle and the second handle is also fixed, having the same problem as described above.

SUMMARY OF THE INVENTION

The present invention has been accomplished in view of the above-described circumstances. It is a main object of the present invention to provide a portable tile cutter, which allows adjustment of the gap between a user's hands when grasping the two handles of the portable tile cutter, according to the user's needs To achieve this and other objects of the present invention, a portable tile cutter comprises a main unit, a cutter blade, a driving unit, a first handle and a second handle. The main unit comprises a base frame, and a guard connected to the base frame. The cutter blade is pivotally mounted at the guard. The driving unit is connected to the guard and operable to rotate the cutter blade. The first handle is connected to the driving unit. The second handle is connected to the guard, and has a grip. The component parts of the portable tile cutter are so arranged that moving one or both of the driving unit and the second handle can achieve adjustment of the gap between the first handle and the grip of the second handle.

The main effect of the present invention is that the portable tile cutter allows adjustment of the isolation gap between the first handle and the grip of the second handle by moving at least one of the driving unit and the second handle relative to the main unit, achieving gripping stability.

Other and further advantages and features of the present invention will be understood by reference to the following specification in conjunction with the accompanying drawings.

DETAILED DESCRIPTION OF THE INVENTION

Figure 1:
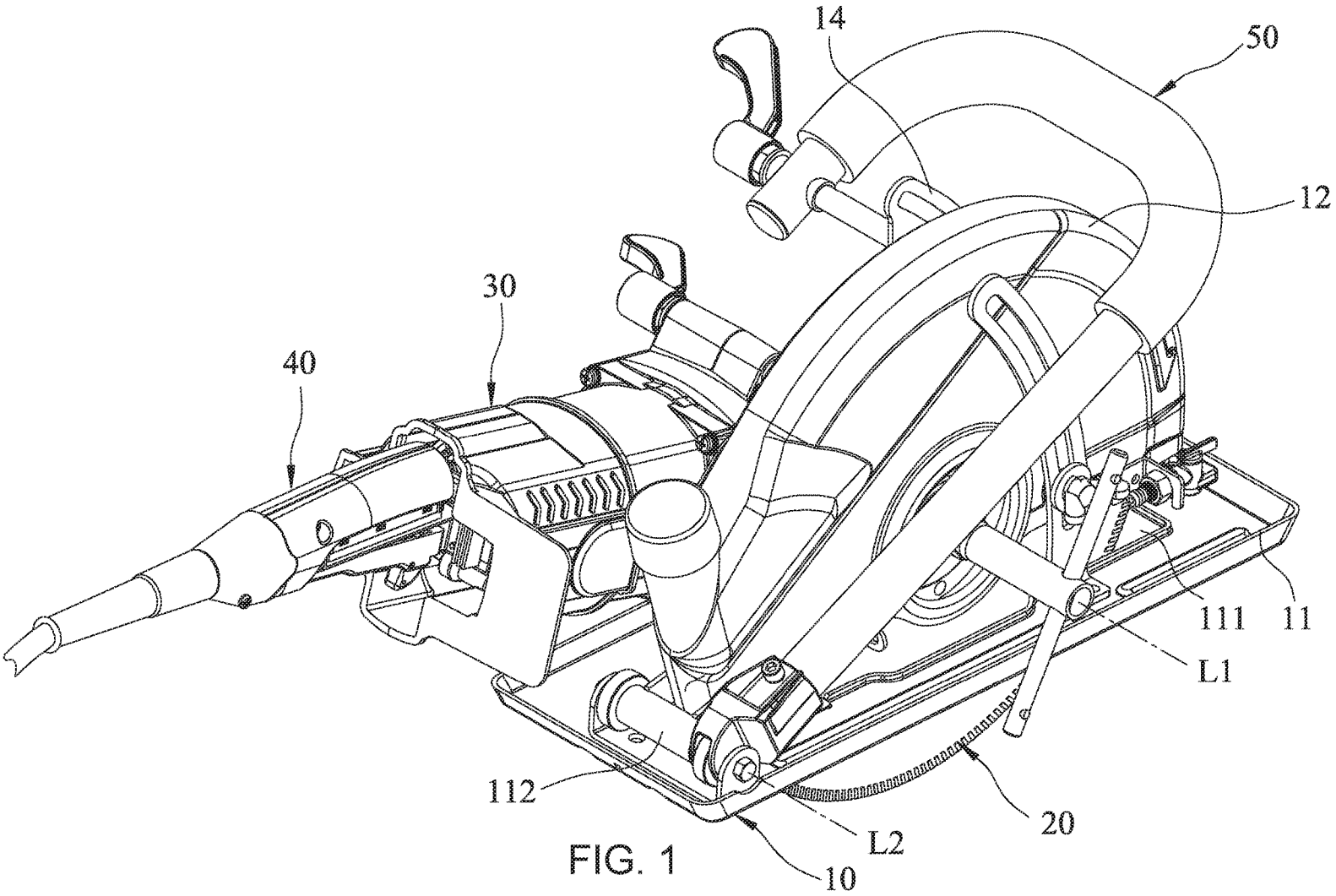
FIG. 1 is an oblique top elevational view of a portable tile cutter in accordance with the present invention.
Figure 2:
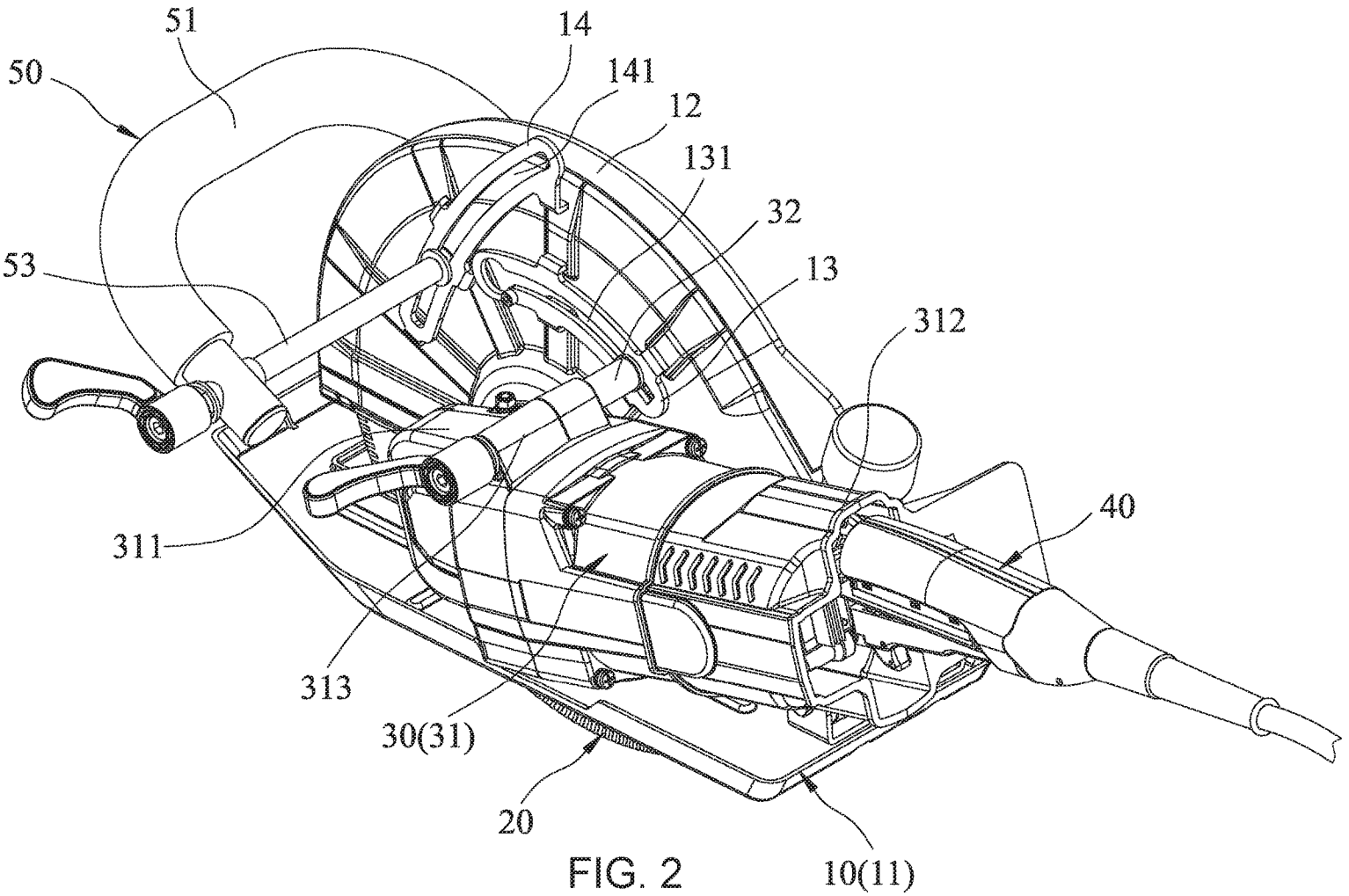
FIG. 2 corresponds to FIG. 1 when viewed from another angle.
Figure 3:
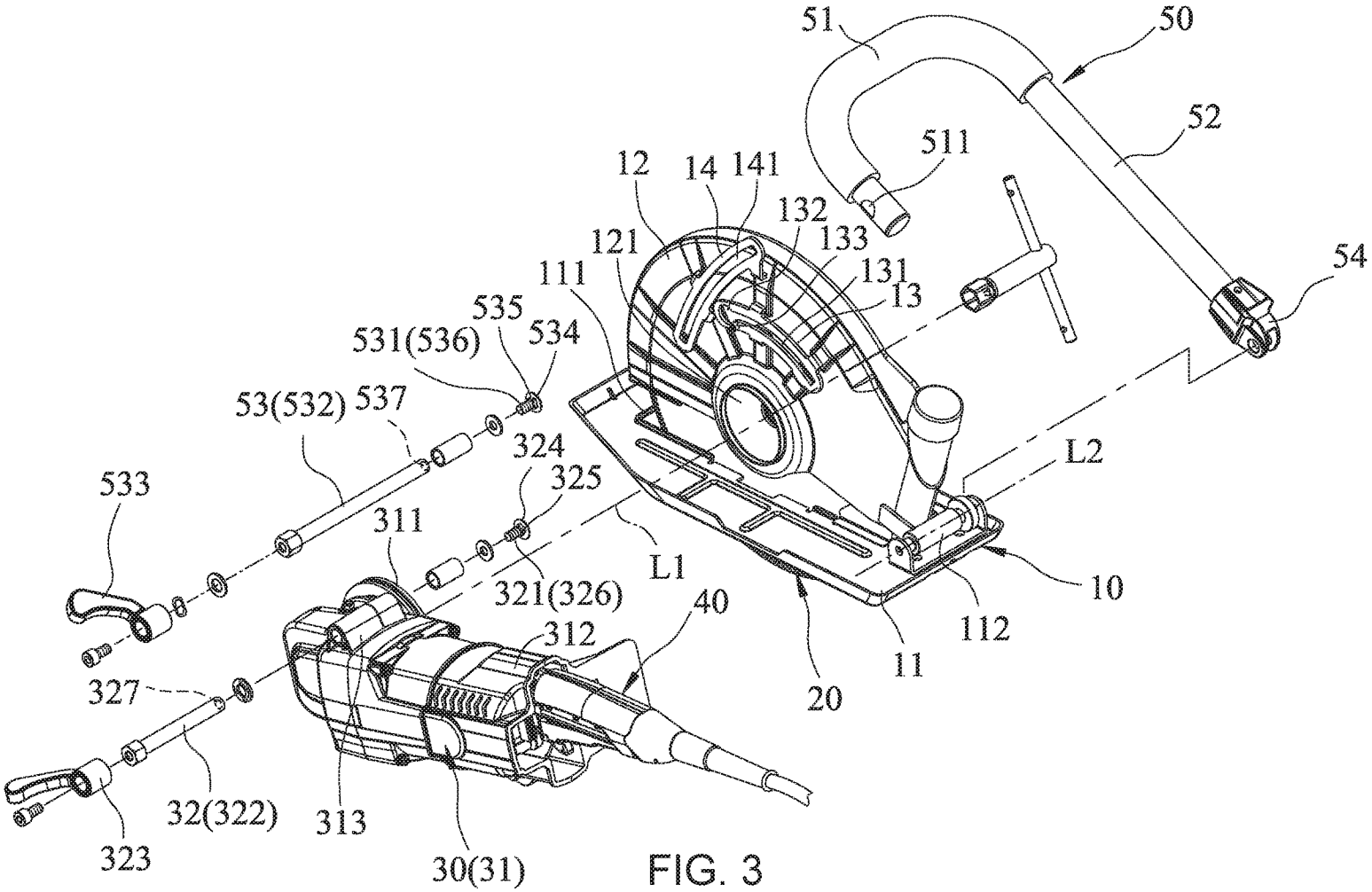
FIG. 3 is an exploded view of the portable tile cutter in accordance with the present invention.

Referring to FIGS. 1, 2 and 3, a portable tile cutter in accordance with the present invention is shown. The portable tile cutter generally comprises a main unit 10, a cutter blade 20, a driving unit 30, a first handle 40, and a second handle 50.

The main unit 10 comprises a base frame 11 shaped like a rectangular pan, a guard 12 connected to the base frame 11, a first sliding guide 13 fixedly mounted at the guard 12, and a second sliding guide 14 fixedly mounted at the guard 12 and disposed at one lateral side relative to the first sliding guide 13.

The base frame 11 comprises a rectangular through hole 111, a pivot axle 112 arranged at one end of the rectangular through hole 111 and extending along a second axis L2. The guard 12 is a semi-circular hollow shell with the open side thereof facing toward the rectangular through hole 111, comprising a center hole 121 that extends along a first axis L1. The first sliding guide 13 is an arc-shaped plate that includes an arcuate first sliding slot 131 intersecting the first axis L1, an expanded mounting hole 132 located on one end of the arcuate first sliding slot 131, and a stopper 133 detachably mounted in between the arcuate first sliding slot 131 and the expanded mounting hole 132. The second sliding guide 14 is an arcuate plate a second arcuate sliding slot 141 surrounding intersecting the second axis L2. The second sliding guide 14 has one end thereof extending to outside the peripheral edge of the guard 12.

The cutter blade 20 is pivotally mounted in the guard 12.

The driving unit 30 is rotatably connected to the guard 12, and adapted for rotating the cutter blade 20. The driving unit 30 comprises a drive member 31 (such as a motor), and a first connection member 32 coupled to the drive member 31 and movable along the first sliding guide 13. The drive member 31 comprises a connection end portion 311 connected to the center hole 121 and adapted for rotating the cutter blade 20, an opposing outer end portion 312, and a positioning block 313 spaced between the connection end portion 311 and the outer end portion 312. The first connection member 32 coupled to the drive member 31 includes a first pin rod 321 mounted in the first sliding slot 131 and prohibited from rotation relative to the first sliding slot 131, a first connection rod 322 fastened to the first pin rod 321, and a first operating grip 323 connected to the first connection rod 322. The first pin rod 321 comprises a first baffle 324 positioned between the first sliding guide 13 and the guard 12, a rectangular engagement block 325 affixed to the first baffle 324, and a first screw rod 326 fixedly mounted at the first engagement block 325. The first baffle 324 is inserted through the expanded mounting hole 132 into the gap between the first sliding guide 13 and the guard 12 for allowing the first engagement block 325 to slide in the first sliding slot 131 and prohibiting the first engagement block 325 to rotate relative to the first sliding slot 131. The first connection rod 322 is mounted in the positioning block 313 of the drive member 31, and has one end fixedly connected to the first operating grip 323 and an opposite end provided with a first screw hole 327 and threaded onto the first screw rod 326.

The first handle 40 is connected to the outer end portion 312 of the driving unit 30.

The second handle 50 is connected to the guard 12 and rotatable relative to the guard 12, and comprises a U-shaped grip 51, a straight extension rod 52 connected to one end of the U-shaped grip 51, a second connection member 53 movable along the second sliding guide 14, and a pivot connection portion 54 fixedly connected to a distal end of the extension rod 52 and pivotally connected to the pivot axle 112 of the base frame 11. The U-shaped grip 51 comprises a through hole 511 located at one end thereof opposite to the extension rod 52. The second connection member 53 comprises a second pin rod 531 mounted in the second sliding slot 141 and prohibited from rotation relative to the second sliding slot 141, a second connection rod 532 fastened to the second pin rod 531, and a second operating grip 533 connected to the second connection rod 532. The second connection rod 532 is pivotally mounted in the through hole 511 of the U-shaped grip 51. The second pin rod 531 comprises a second baffle 534 positioned between the second sliding guide 14 and the guard 12, a rectangular second engagement block 535 fixedly mounted at the second baffle 534, and a second screw rod 536 fixedly mounted at the second engagement block 535. The second engagement block 535 is slidably mounted in the second sliding slot 141 and prohibited from rotation relative to the second sliding slot 141. The second connection rod 532 has one end thereof fixedly connected to the second operating grip 533, and an opposite end provided with a second screw hole 537 and threaded onto the second screw rod 536. The pivot connection portion 54 is mounted at one end of the extension rod 52 opposite to the U-shaped grip 51.

Figure 5:
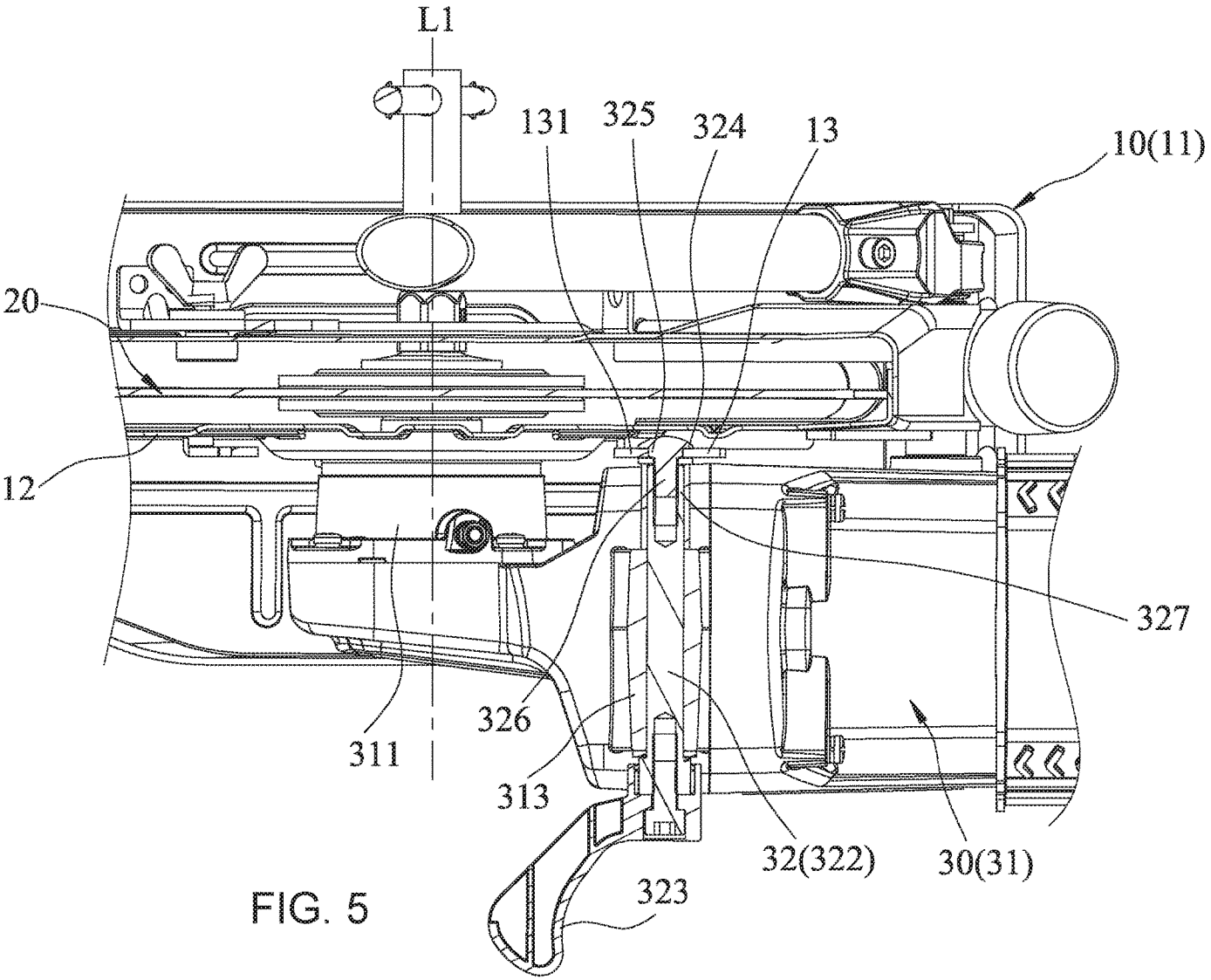
FIG. 5 is a sectional view taken along line V-V of FIG. 4.
Figure 6:
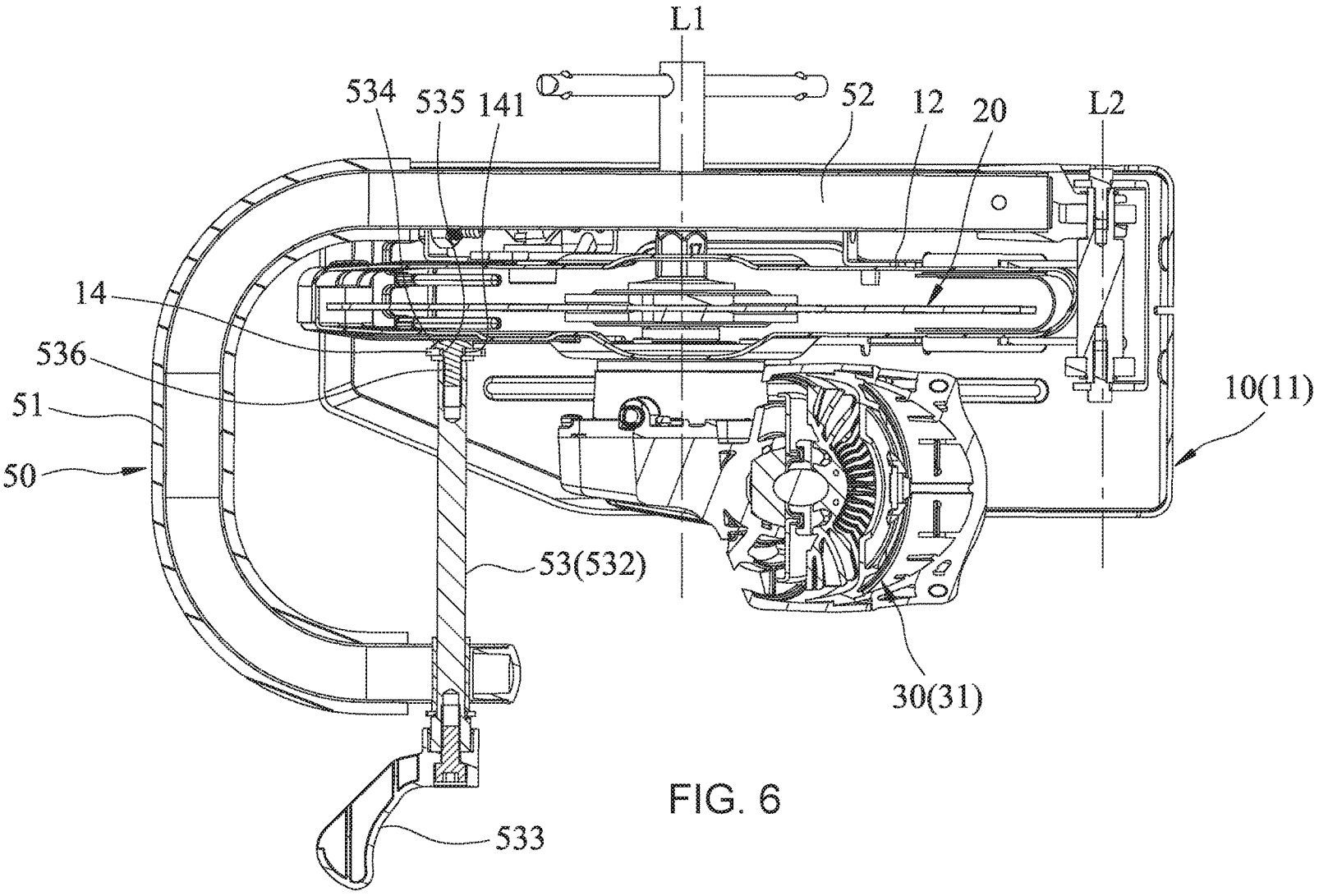
FIG. 6 is a sectional view taken along line VI-VI of FIG. 4.

Referring to FIGS. 3, 5 and 6, in installation, under the condition that the first sliding guide 13 is detached, the first baffle 324 of the first connection member 32 of the driving unit 30 is inserted into the expanded mounting hole 132, and then the first connection member 32 is moved along the first sliding slot 131 to the extent where the first baffle 324 and one end edge of the first connection rod 322 are respectively disposed at two opposite sides of the first sliding guide 13. Thereafter, the stopper 133 is fastened to the first sliding guide 13. Thus, the first connection member 32 is connected to the first sliding guide 13, enabling the first handle 40 to be indirectly connected to the guard 12. At this time, the second pin rod 531 is detached from the second connection rod 532. Then, the second screw rod 536 of the second pin rod 531 from an outer periphery of the guard 12 is inserted into the second sliding slot 141 to force the second engagement block 535 into the second sliding slot 141. Thereafter, the second connection rod 532 and the second pin rod 531 are fastened together. Thus, the second connection member 53 is connected to the second sliding guide 14, and the second handle 50 is connected to the guard 12.

Referring to FIGS. 1, 2 and 4 and FIG. 5, after the portable tile cutter is assembled, the position of the first connection member 32 is adjusted to approach one end of the first sliding slot 131 opposite to the expanded mounting hole 132, and then the first operating grip 323 is turned to fix the first connection rod 322 relative to the first screw rod 326, causing the first baffle 324 and the first connection rod 322 to be clamped onto the two opposite sides of the first sliding guide 13, and thus, the driving unit 30 and the first handle 40 are positively secured in position relative to the main unit 10. Thereafter, as shown in FIG. 6, the position of the second connection member 53 is adjusted to be at one end of the second sliding slot 141 in proximity to the first axis L1, and then the second operating grip 533 is turned to fix the second connection rod 532 relative to the second screw rod 536.

By clamping the second baffle 534 and one end of the second connecting rod 532 on the two opposite sides of the second sliding guide 14, the second handle 50 is positively secured in position relative to the main unit 10.

Figure 4:
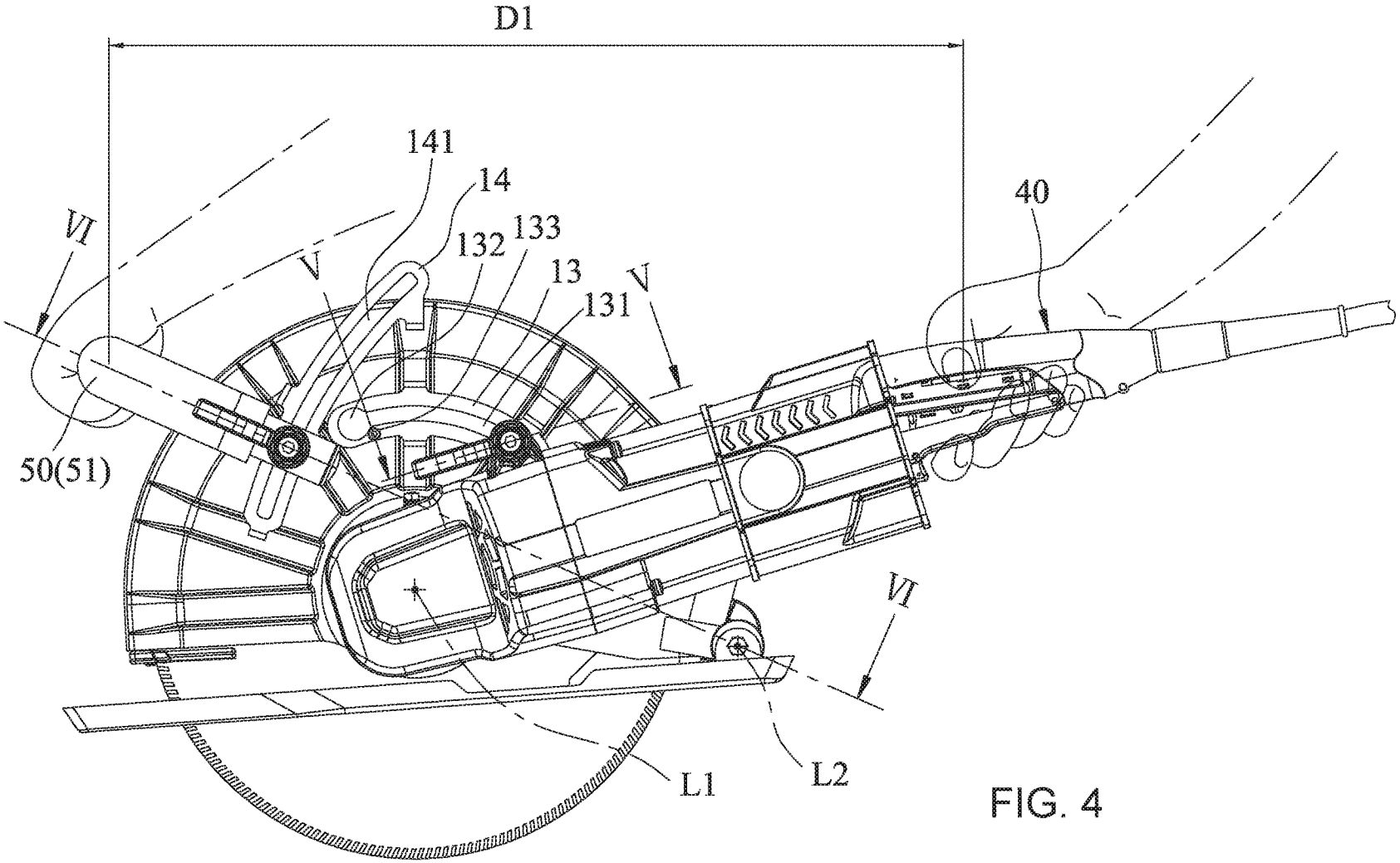
FIG. 4 is a side view of the portable tile cutter in accordance with the present invention.

As illustrated in FIG. 4, when the first handle 40 is positively secured in position, a large isolation distance D1 is defined between the midpoint of the first handle 10 and the U-shaped grip 51 of the second handle 50 to fit a user having a relatively larger body size. At this time, the user's both hands can grip the first handle 40 and the U-shaped grip 51 of the second handle 50 to control the tile cutter steadily.

Figure 7:
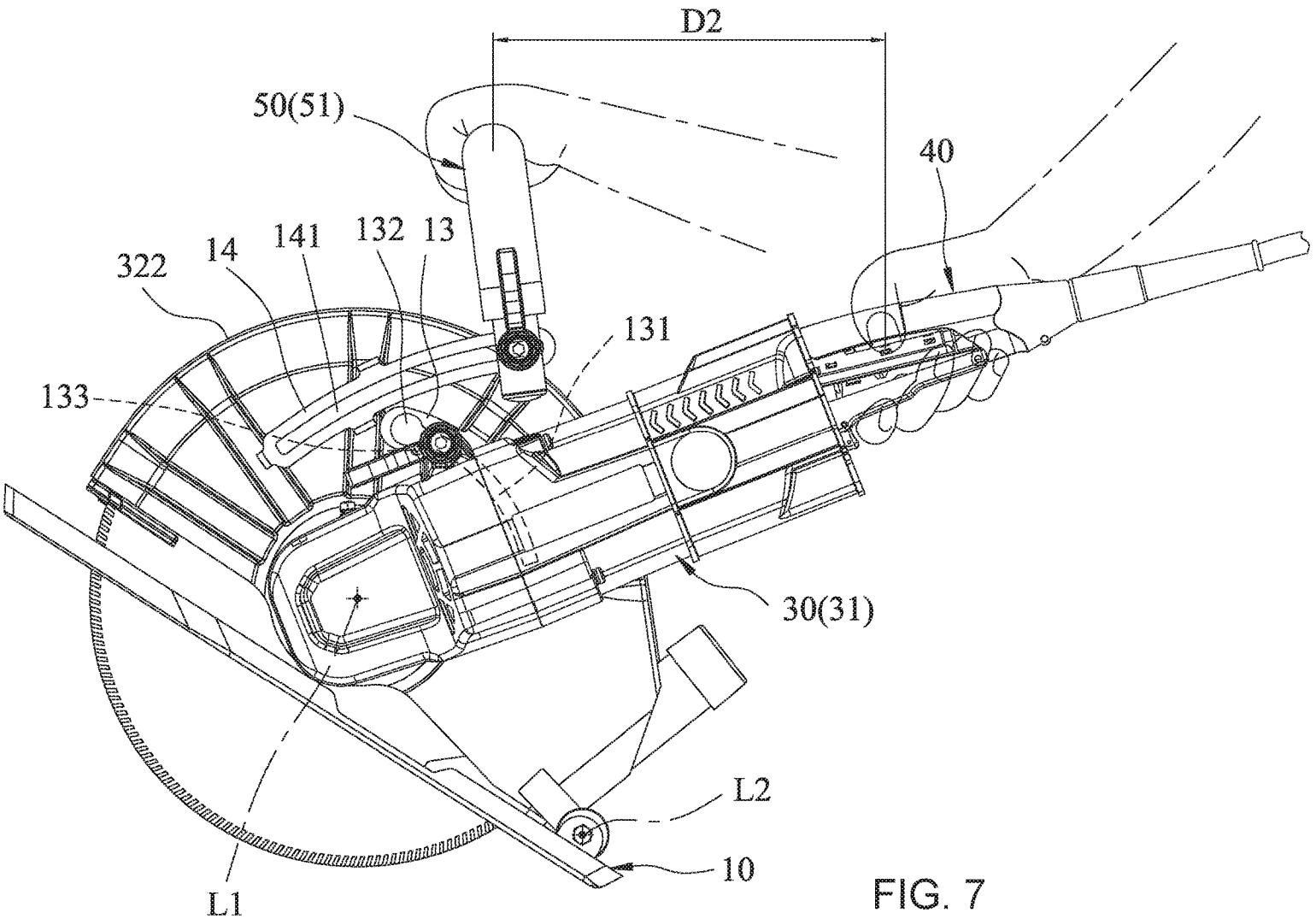
FIG. 7 is a schematic operational view illustrating an adjustment of the isolation gap between the first handle and the grip of the second handle.

In order to adjust the isolation distance between the first handle 40 and the second handle 50, as illustrated in FIG. 5 and FIG. 7, the first operating grip 323 is turned to loosen the first connection rod 322 relative to the first screw rod 326. Subject to the effect that the first engagement block 325 is slidably inserted into the first sliding slot 131 and prohibited from rotation relative to the first sliding slot 131, operating the driving unit 30 and the first handle 40 can drive the first connection member 32 to move toward the expanded mounting hole 132. After being adjusted to the expected position, the first operating grip 323 is fastened tightly to clamp the first baffle 324 and the end edge of the first connection rod 322 on the two opposite sides of the first sliding guide 13, locking the driving unit 30 and the first handle 40 to the main unit 10. Further, using the stopper 133 to abut against the first connection rod 322 can prohibit the first connection member 32 from sliding to the expanded mounting hole 132 during the adjustment, preventing disconnection of the first sliding guide 13.

Referring to FIG. 6 and FIG. 7, when the second operating grip 533 is turned to loosen the second connection rod 532 from the second screw rod 536, subject to the effect that the second engagement block 535 is slidably inserted into the second sliding slot 141 and prohibited from rotation relative to the second sliding slot 141, the user can operate the second handle 40 to move the second connection member 53 toward one end of the second sliding slot 141 of the first axis L1. At this time, the second handle 50 is turned about the second axis L2 to the desired position. After being adjusted to the desired position, the second operating grip 533 is tightly fastened to clamp the second baffle 534 and the end edge of the second connection rod 532 on the two opposite sides of the second sliding guide 14, thereby locking the second handle 50 to the main unit 10.

As illustrated in FIG. 7, under this status, a small isolation distance D2 smaller than the aforesaid large isolation distance D1 is defined between the midpoint of the first handle 40 and the U-shaped grip 51 of the second handle 50 to fit a user having a relatively smaller body size. At this time, the user's both hands can grip the first handle 40 and the U-shaped grip 51 of the second handle 50 to control the tile cutter steadily.

Except at the end positions shown in FIG. 4 and FIG. 7, the first sliding slot 131 and the second sliding slot 141 allow stepless adjustment of the first connection member 32 and the second connection member 53 respectively. Thus, adjustment can be made according to the user's body size or different operating posture and can adjust the difference between the midpoint of the first handle 40 and the center point of the grip 51 of the second handle 50.

It's worth mentioning that in the above-described embodiment, the driving unit 30 and the second handle 50 are movable relative to the main unit 10. In actual application, the driving unit 30 or the second handle 50 can be independently moved relative to the main unit 10 to achieve adjustment of the isolation gap between the first handle 40 and the grip 51 of the second handle 50.

In conclusion, the invention provides a portable tile cutter, which allows adjustment of the isolation gap between the first handle 40 and the grip 51 of the second handle 50 by moving at least one of the driving unit 30 and the second handle 50 relative to the main unit 10, achieving gripping stability. Further, the overall structure of the portable tile cutter is quite simple, facilitating quick adjustment and effectively achieving the object of the present invention.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A portable tile cutter, comprising:

a main unit comprising a base frame and a guard connected to said base frame;

a cutter blade pivotally mounted at said guard;

a driving unit connected to said guard and operable to rotate said cutter blade;

a first handle connected to said driving unit; and a second handle connected to said guard, said second handle comprising a grip;

wherein at least one of said driving unit and said second handle is movable to adjust a gap between said first handle and said grip of said second handle, wherein said driving unit and said second handle are connected to said guard and movable relative to said guard, and wherein said main unit further comprises a first sliding guide fixedly mounted at said guard and a second sliding guide fixedly mounted at said guard; said driving unit comprises a drive member and a first connection member coupled to said drive member and movable along said first sliding guide; and said second handle further comprises a second connection member movable along said second sliding guide.

2. The portable tile cutter as claimed in claim 1, wherein said second handle further comprises a pivot connection portion pivotally connected to said base frame.

3. The portable tile cutter as claimed in claim 2, wherein said second handle further comprises a straight extension rod connected to the grip; and said pivot connection portion of said second handle is connected to one end of said straight extension rod opposite to the said grip of said second handle.

4. The portable tile cutter as claimed in claim 1, wherein said first sliding guide of said main unit is an arcuate plate comprising an arcuate first sliding slot; said first connection member of said driving unit comprises a first pin rod mounted in said first sliding slot and prohibited from rotation relative to said first sliding slot, a first connection rod fastened to said first pin rod and a first operating grip connected to said first connection rod, and said first connection rod is pivotally connected to said drive member.

5. The portable tile cutter as claimed in claim 4, wherein said first pin rod of said first connection member of said driving unit comprises a first baffle positioned between said first sliding guide and said guard, a rectangular first engagement block fixedly mounted at said first baffle and a first screw rod fixedly mounted at said first engagement block, said first engagement block is slidably inserted into said first sliding slot and prohibited from rotation relative to said first sliding slot, and said first connection rod is threaded onto said first screw rod.

6. The portable tile cutter as claimed in claim 4, wherein said first sliding guide of said main unit further comprises an expanded mounting hole disposed in communication with said first sliding slot, and a stopper detachably mounted in between said first sliding slot and said expanded mounting hole.

7. The portable tile cutter as claimed in claim 1, wherein said second sliding guide of said main unit is an arcuate plate comprising an arcuate second sliding slot; said second connection member of said second handle comprises a second pin rod inserted into said second sliding slot and prohibited from rotation relative to said second sliding slot, a second connection rod fastened to said second pin rod, and a second operating grip connected to said second connection rod.

8. The portable tile cutter as claimed in claim 6, wherein said second pin rod of said second handle comprises a second baffle positioned between said second sliding guide and said guard, a rectangular second engagement block fixedly mounted at said second baffle, and a second screw rod fixedly mounted at said second engagement block, said second engagement block is slidably inserted into said second sliding slot and prohibited from rotation relative to said second sliding slot, and said second connection rod is threaded onto said second screw rod.

* * * * *